US007086613B2

(12) United States Patent
Hennessy

(10) Patent No.: US 7,086,613 B2
(45) Date of Patent: Aug. 8, 2006

(54) LIGHTWEIGHT SOLENOID-OPERATED SPRAY GUN

(75) Inventor: Timothy H. Hennessy, Plainfield, IL (US)

(73) Assignee: Spraying Systems Co., Wheaton, IL (US)

( * ) Notice: Subject to any disclaimer, the term of this patent is extended or adjusted under 35 U.S.C. 154(b) by 277 days.

(21) Appl. No.: 10/351,237

(22) Filed: Jan. 24, 2003

(65) Prior Publication Data

US 2004/0144869 A1 Jul. 29, 2004

(51) Int. Cl.
*B05B 1/30* (2006.01)

(52) U.S. Cl. ..... 239/583; 239/585.1; 239/585.5; 239/407; 239/417.5; 251/129.21

(58) Field of Classification Search ..... 239/583, 239/407, 413, 416.4, 417.3, 416.5, 417.5, 239/128, 132.5, 585.5; 251/129.21
See application file for complete search history.

(56) References Cited

U.S. PATENT DOCUMENTS 4,368,852 A * 1/1983 Sharp et al. ..... 239/695
4,946,107 A * 8/1990 Hunt ..... 239/585.4
4,988,015 A * 1/1991 Price ..... 222/1
5,294,057 A * 3/1994 Hamilton ..... 239/417.3

* cited by examiner

*Primary Examiner*—Dinh Q. Nguyen
(74) *Attorney, Agent, or Firm*—Leydig, Voit & Mayer, Ltd.

(57) ABSTRACT

A solenoid-operated liquid spray gun having a lightweight, corrosion resistant plastic housing which enables the spray gun to be mounted on and be more easily moved by robotic transfer devices. To effect the necessary flux loop within the plastic-housed spray gun for reciprocating a valve plunger in response to energization of the solenoid coil, the spray gun includes a radially disposed flux-directing member adjacent at least one end of the coil. The flux-directing member, while extending radially outwardly a distance less than the diameter of solenoid coil, effects efficient flux direction for operating the solenoid notwithstanding the lack of a magnetic conductive medium provided by the metal housing of conventional solenoid-operated spray guns.

21 Claims, 2 Drawing Sheets

LIGHTWEIGHT SOLENOID-OPERATED SPRAY GUN

FIELD OF THE INVENTION

The present invention relates generally to spray guns adapted for directing small volume, finely atomized liquid at short operating intervals, and more particularly, to solenoid operated spray guns in which a valve plunger of the spray gun is movable at high reciprocating speeds by means of an electrically operated solenoid.

BACKGROUND OF THE INVENTION

Solenoid operated spray guns, such as shown in U.S. Pat. No. 6,182,908 assigned to the same assignee as the present application, are well known for generating precisely controlled finely atomized sprays in many industrial spray applications. In order to provide a flux path for a solenoid coil to operate a valve plunger, it has been necessary for such spray guns to be made largely of metal, typically steel. Hence, such solenoid-operated spray guns are relatively expensive to manufacture. Moreover, due to the weight of such steel constructed spray guns, it often can be difficult to support the spray gun on movable robotic arms or the like, particularly if a plurality of such spray guns must be supported at a common location. Furthermore, when the spray gun is moved by the robotic arm to different operating stations, the momentum of such heavy spray guns can make it difficult to precisely stop and locate the spray gun at the station. Such steel constructed solenoid operated spray guns also are highly corrosive in many industrial environments in which the spray guns are used.

OBJECTS AND SUMMARY OF THE INVENTION

It is an object of the present invention to provide a lightweight solenoid operated liquid spray gun which is adapted for easier support and precise positioning in spray applications with which the gun is used.

Another object is to provide a solenoid operated spray gun as characterized above which is less susceptive to corrosion from manufacturing or processing environments.

A further object is to provide a solenoid operated spray gun of the above kind which lends itself to more economical manufacture.

Other objects and advantages of the invention will become apparent upon reading the following detailed description and upon reference to the drawings, in which:

Figure 1:
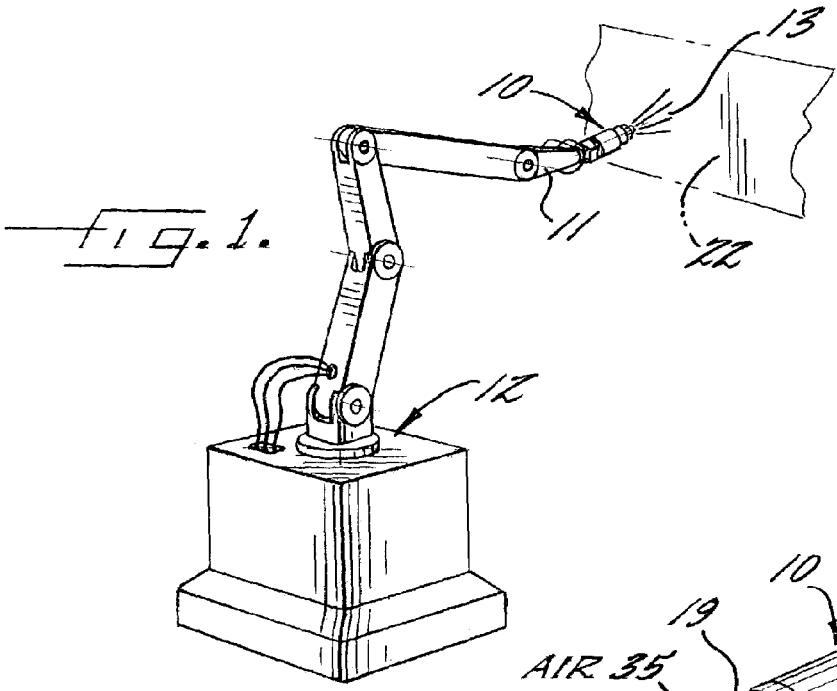
FIG. 1 is a perspective of a solenoid-operated spray gun in accordance with the present invention mounted for selective positioning by a robot.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

BRIEF DESCRIPTION OF THE PREFERRED EMBODIMENT

Figure 4:
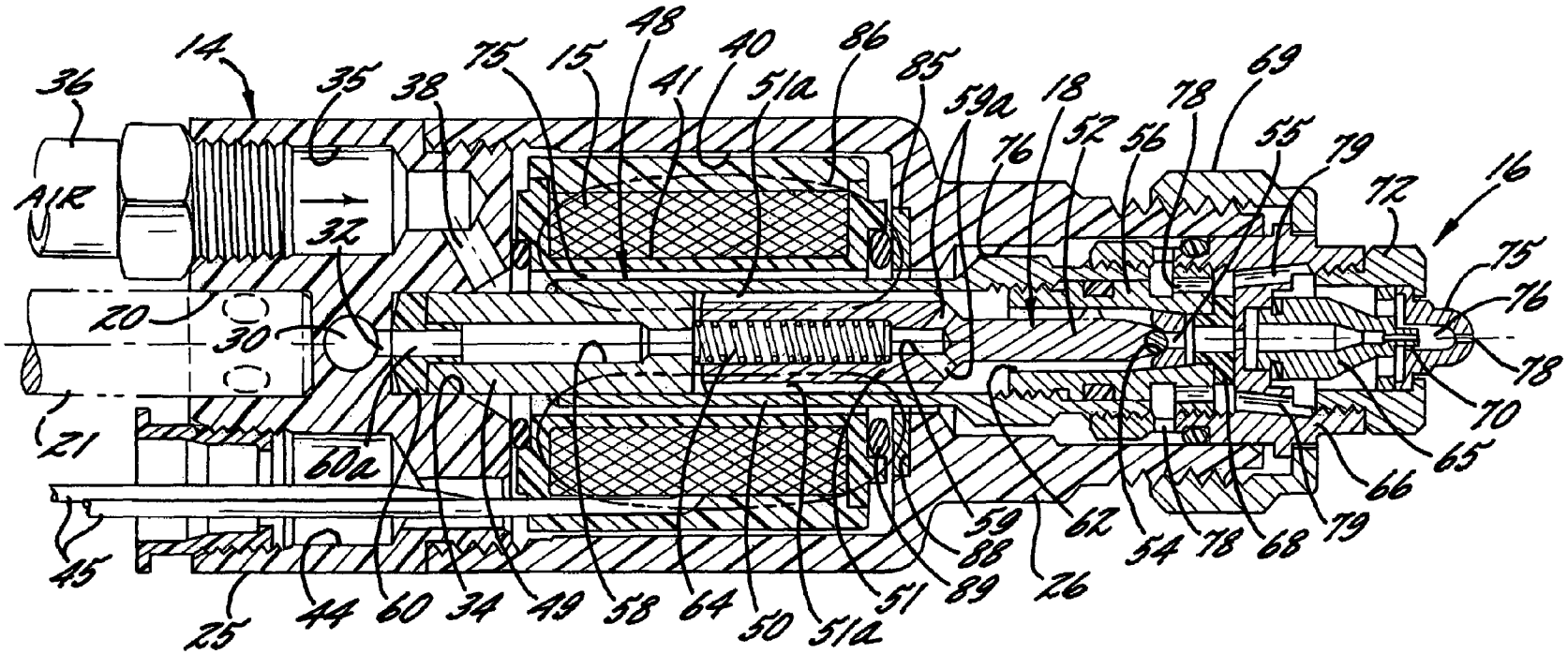
FIG. 4 is an enlarged longitudinal section of one of the spray guns, taken in the plane of line 4—4 in FIG. 2.

Referring now more particularly to the drawings, there is shown an illustrative solenoid operated gun 10 in accordance with the invention supported on the movable arm or articulated linkage 11 of a robot 12 of a conventional type. The illustrated spray gun 10, as depicted in FIG. 4, includes a housing 14, a solenoid coil 15 contained centrally within the housing 14, a spray nozzle assembly 16 supported at a discharge end of the housing 14, and a valve plunger 18 mounted for controlled reciprocating movement in response to operation of the solenoid coil 15 for controlling the liquid discharge from the spray nozzle assembly 16. To facilitate mounting of the spray gun 10 on the robot arm 11 or other supporting device, the upstream end of the spray gun housing 14 is formed with flats 19, which facilitate engagement by a clamping mechanism or brackets, as well as an axial counterbore 20 which enables mounting of the housing on a support rod 21, as depicted in FIG. 4.

Figure 3:
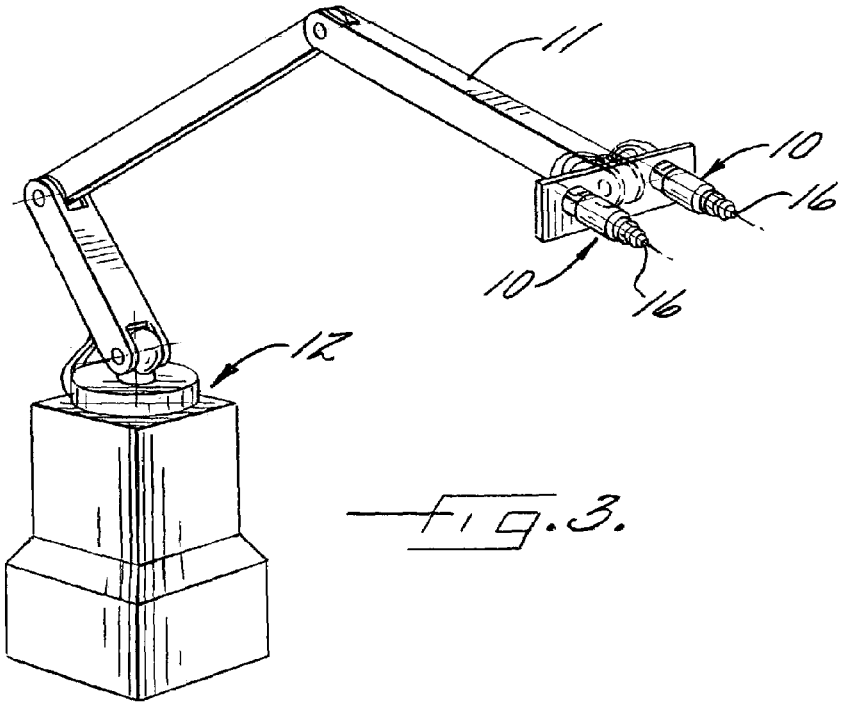
FIG. 3 is a perspective of an alternative embodiment of a robot having two solenoid operated spray guns in accordance with the invention mounted thereon for selective positioning.

As is known in the art, the arm 11 of the robot 12 may be selectively moved for positioning the spray gun 10 such that the finely atomized discharging spray 13 is directed onto selected areas of a surface 22 to be coated or otherwise sprayed, as depicted in FIG. 1. Alternatively, the robot arm may support and carry a plurality of such spray guns 10, as depicted in FIG. 3, for simultaneous direction of a plurality of finely atomized discharging sprays. As indicated above, while such solenoid operated spray guns are useful for directing fine, precisely controllable spray patterns, because of the weight of the spray gun they can be difficult to support on moveable robots and the like, and by reason of their momentum during movement, can be difficult to quickly or precisely position at predetermined spray locations. They can also be highly corrosive in industrial working environments.

In accordance with the invention, the spray gun has a lightweight, non-metallic housing which substantially reduces the weight of the spray gun and enables it to be more easily and precisely positioned by robotic or other supporting devices. The spray gun 10 in this case has a two-part housing 14, comprising a generally cylindrical body 25 and a cover 26 mounted in forwardly extending relation to the body 25. The body 25 and cover 26 both are machine out of rigid plastic material, preferably polyacetal, which can be economically produced and which are relatively light in weight. The plastic housing 14 further defines an outer perimeter of the spray gun that is substantially resistant to corrosion and which protects internal metallic components of the spray gun from exposure to the working environment in which the spray gun is used.

Figure 2:
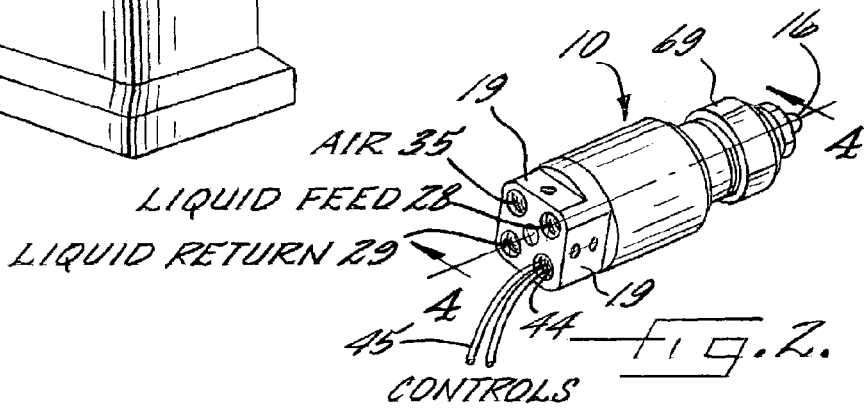
FIG. 2 is an enlarged perspective of the solenoid-operated spray gun shown in FIG. 1.

The illustrated non-metallic housing body 25 is formed with a pair of longitudinally extending liquid ports 28, 29 (FIG. 2), each communicating with an upstream end of the body for receiving respective feed and return lines. The liquid ports 28, 29 are interconnected by a cross bore 30 (FIG. 4), which in turn communicates with a central liquid flow passage 32 that extends into a counterbore 34 formed in a downstream end of the body 25. As in known in the art, supply liquid may be directed to the liquid port 28 with a portion thereof being directed through the return port 29 for continuous recirculation. Alternatively, the return port 29 can be plugged. For communicating pressurized air to the spray gun, the body 25 is formed with a longitudinal air inlet port 35 for coupling to an air supply line 36 (FIG. 4). The air inlet port 35 in this case communicates with an angled feed passage 38 connecting through a downstream end of a body 25.

The non-metallic housing cover 26 defines a forwardly extending cylindrical chamber 40 within which the solenoid coil 15 is contained. The solenoid coil 15 includes a conventional wound coil about a plastic spool or bobbin 41 having an outer cylindrical cover. To enable connection of the coil 15 to an outside electrical source, the housing body 25 is formed with a further longitudinal port 44 through which electrical leads 45 of the coil exit the body 25. It will be understood that various components of the spray gun 10 and their mode of operation are similar to those described in the above-referenced U.S. Pat. No. 5,294,057, the disclosure of which is incorporated herein by reference.

The reciprocal valve plunger 18 of the illustrated spray gun 10 is part of a fluid control module 48 which includes a cylindrical metallic core 49, the upstream end of which is disposed within the counterbore 34 of the plastic body 25, and a metallic cylindrical tube 50 is affixed to the core 49 in forwardly extending relation. The plunger 18, also made of metal, is disposed within the tube 50 immediately downstream of the core 49 for limited relative longitudinal movement. The illustrated plunger 18 has an enlarged diameter, upstream end 51 formed with a plurality of external longitudinal grooves 51*a*. The plunger 18 has a forwardly extending nose or needle portion 52 which, in a closed position, seats in a valve seat 54 closing a central liquid or orifice 55 therein. The valve seat 54 is carried by a seat plug 56 threadably engaging a downstream end of the core tube 50.

For enabling communication of liquid through the control module 48, the core 49 and plunger 18 are formed with respective, concentric longitudinally extending liquid flow passageways 58, 59. A nylon gasket 60 formed with a central passageway 60*a* is disposed within the counterbore 34 of the plastic body 25 in interposed relation between the body 25 and the upstream end of the core 49 for providing sealed communication of liquid between the body 25 and the module 48. The longitudinal passage 59 in the plunger 18 communicates with a plurality of downstream outwardly angled flow passages 59*a* in the plunger, which in turn communicate with an annular liquid flow passage 62 defined about the plunger nose 52. For biasing the valve plunger 18 toward a closed position with the nose 52 closing the valve seat orifice 55, as shown in FIG. 4, a spring 64 is disposed in an enlarged counterbore section of the longitudinal liquid flow passage 59 of the plunger in interposed relation with a downstream end of the core 49. It will be seen that when the valve plunger 18 is moved to an open position against the biasing force of the spring 64, liquid is directed through the valve seat orifice 55 to and through the downstream nozzle assembly 16.

The spray nozzle assembly 16 in this case includes a spray tip 65 mounted within a tip adapter 66, which in turn is mounted within a downstream end of the housing cover 26. A nylon bushing 68 is interposed between an upstream end of the tip adaptor 66 and the downstream end of the seat plug 56. For releasably securing both the tip adaptor 66 and the upstream control module 48 in mounted position, a retaining ring 69 engageable with the tip adaptor 66 is threaded onto a downstream end of the housing cover 26. The spray tip 65 in this instance has an elongated forwardly extending nose which defines a liquid discharge orifice 70.

For facilitating atomization and direction of the discharging liquid flow stream, the spray nozzle assembly 16 includes an air cap 75 which is mounted in surrounding relation to the liquid discharge orifice 70, being retained by a retaining ring 72 threadedly engaging a downstream end of the tip adaptor 66. The air cap 75, which may be of a conventional type, defines a mixing chamber 76 downstream of the liquid discharge orifice 70 with a spray discharge orifice 78 in axially aligned relation to the liquid discharge orifice 70.

For communicating pressurized air between the air inlet port 35 to the air cap 75, the outer periphery of the module 48 and a central cylindrical opening of the coil spool 41 define an annular air flow passageway 75 through the coil 15 and into an annular passageway 76 defined between the outer periphery of the module 48 and a cylindrical wall defined by the downstream end of the housing cover 26. The annular passage 76 in turn communicates with the air cap 75 through passages 78, 79 in the seat plug 56 and tip adaptor 66, respectively. The air cap 75, being disposed in surrounding relation with the liquid discharge orifice 70, receives pressurized air and channels it into impinging relation to the discharging liquid prior to and during discharge from the air cap discharge orifice 78.

In order to reciprocate the plunger 18 and valve needle 52 between open and closed positions during operation of the spray gun 10 as an incident to energization of the solenoid coil 15, it is necessary that a flux loop be generated which will encompass and magnetically act upon the plunger. Heretofore, to create the necessary flux loop for moving the spray gun plunger, it has been necessary that the spray gun have a magnetically conductive metal outer structure or housing in surrounding relation to the plunger and core through which flux can be guided in a loop. It has not been possible for solenoid-operated spray guns to have inexpensive lightweight plastic constructions because such material would not enable proper generation and guidance of the necessary flux loop.

In carrying out the invention, a metallic, radial flux-deflecting element 85 is provided adjacent at least one end of the solenoid coil 15 for directing flux induced in the core 49 and plunger 18 from energization of the coil 15 in an outward radial direction, which initiates a flux loop 86 sufficient for operating the plunger 18, notwithstanding the lack of an outer metallic, flux-conducting medium. The flux-deflecting element 85 in this case is in the form of a flat metallic washer or like radial member, preferably made of iron or steel, disposed adjacent a downstream end of the coil 15 in closely spaced surrounding relation about the core tube 50. The flux-deflecting element 85 has a relatively narrow width and is mounted in a plane perpendicular to the longitudinal axis of the spray gun 10. The radial flux-deflecting member or washer 85 in this case has a central opening sized larger than the core tube 50 so as not to interrupt air flow passage along the outer perimeter of the core 49, but small enough such that flux induced in the core 50 and plunger 18 will travel through and be directed in an outward radial direction by the flux-deflecting element 85. The flux-deflecting element 85 also may be relatively small in overall size, having an outer diameter less than the outer diameter of the coil 15. In the illustrated embodiment, the radial flux-deflecting element 85 is mounted within a recess 88 in an end wall of the plastic housing cover 26, with a sealing O-ring 89 interposed between the flux-deflecting member and an axial end of the coil bobbin 41.

It has unexpectedly been found that even with the non-metallic spray gun housing 14, namely the plastic housing body 25 and cover 26, the relatively small sized radial flux-deflecting element 85 is effective in response to energization of the solenoid coil 15 for initiating an outward radial direction to a flux path, sufficient to find its way, via a loop 86, for moving the valve plunger 18 against the force of the spring 64. It will be understood that while the illustrated flux-directing element 85 is disposed adjacent a downstream end of the solenoid coil 15, alternatively, it could be mounted at the upstream end. Likewise, flux-directing elements 85 could be provided at opposite ends of the solenoid coil 15, but applicant's invention unexpectedly has determined that a single flux-directing element is adequate for reliable operation of the spray gun.

By selectively energizing the solenoid coil 15, therefore, it will be seen that flux generated in the metallic core 66 and plunger 18 is directed radially outwardly by the flux deflecting member 85 which travels, without magnetically conductive medium, in a loop which returns in a direction towards the core 49, as shown in FIG. 4, causing the valve plunger to be moved rearwardly against the force of the biasing spring 92 to open the valve seat discharge orifice 75 and permit the flow of pressurized liquid therethrough. The de-energization of the solenoid coil 55 permits the valve plunger 18 to be returned to its closed position under the force of the biasing spring 64. Rapid operation of the solenoid coil 15 permits high-speed cyclic operation of the valve plunger 18 for the desired liquid spray discharge.

By reason of the non-metallic plastic housing of the spray gun, it will be appreciated that the spray gun is substantially lighter in weight than conventional solenoid operated spray guns having metal housings or outer structures heretofore believed necessary for solenoid operation. Hence, the spray gun of the present invention may be mounted on many robotic transfer arms or the like, such as shown in FIG. 1, heretofore not possible with conventional spray guns. By reason of its lighter weight, the spray gun also may be more easily and precisely moved and positioned during selective spraying operations. The non-metallic outer housing further is less susceptible to corrosion and effectively protects the internal metallic components of the spray gun. The non-metallic housing also lends itself to more economical manufacture.

What is claimed is:

1. A liquid spray gun comprising:

a housing having a liquid inlet for connection to a pressurized liquid supply source, a discharge nozzle at a downstream end of said housing, a selectively energizable solenoid coil supported within said housing, an elongated core member disposed at least partially within said coil, a valve plunger disposed at least partially within said coil and being mounted for reciprocating linear movement relative to said coil and core for controlling the discharge of liquid from said nozzle, said core and plunger being made of metal, said housing being made of a non-metallic, non-magnetic conductive material, said housing being made of a non-metallic, non-magnetic conductive material such that over at least a portion of an elongated length of said coil no metallic flux-directing material is disposed outwardly of the coil, and a metallic flux-directing element adjacent an end of said coil for directing flux in a loop at least partially encompassing said core and plunger in response to energization of said coil for effecting reciprocating linear movement of said plunger.

2. The spray gun of claim 1 in which said flux-directing element is a metal flux-deflecting member mounted in outwardly extending radial relation to said core and plunger.

3. The spray gun of claim 2 in which said metal flux-deflecting member is an annular plate-like member with a central opening.

4. The spray gun of claim 3 in which said flux-deflecting member is a metal washer.

5. The spray gun of claim 2 in which said flux-deflecting member being disposed in a plane perpendicular to an axis of said coil.

6. The spray gun of claim 2 in which said flux-deflecting member has an outer diameter less than the outer diameter of said coil.

7. The spray gun of claim 2 in which said core has a forwardly extending metal tube within which said plunger is disposed for reciprocating movement, and said flux-deflecting member has a central opening greater than the diameter of said tube and core and extends in outwardly radial direction with respect thereto.

8. The spray gun of claim 2 in which said housing includes a pressurized air inlet for connection to a pressurized air supply source for enabling communication of air through said gun to said nozzle for assisting in atomization and direction of liquid discharging from said nozzle.

9. The spray gun of claim 8 in which said pressurized air communicates through an air passage in said gun extending through said coil and flux-deflecting member.

10. The spray gun of claim 9 in which said core has a forwardly extending metal tube within which said plunger is disposed for reciprocating movement, said coil, core, and tube defining an air flow passage through which pressurized air travels through said spray gun to said nozzle, and said flux-deflecting member having a central opening greater than the diameter of said tube and core so as not to interfere with the flow of pressurized air through said air flow passage.

11. The spray gun of claim 8 in which said housing includes a plastic body portion within which said liquid and air inlets are formed and a plastic cover mounted in forwardly extending relation to said body which defines a chamber within which said coil is contained.

12. The spray gun of claim 11 in which said spray nozzle is mounted at a downstream end of said cover, said spray nozzle including a liquid spray tip which defines a liquid discharge and a surrounding air cap into which pressurized air from said air inlet is communicated for facilitating atomization and direction of liquid from said nozzle.

13. The spray gun of claim 2 in which said metal flux-deflecting member is disposed at a downstream end of said coil.

14. A liquid spray apparatus comprising:

a robot having a movable arm, a liquid spray gun mounted on said arm for movement therewith, said spray gun including a housing having a liquid inlet for connection to a liquid supply source, a discharge nozzle at a downstream end of said housing, a selectively energizable solenoid coil supported within said housing, an elongated metallic core member disposed at least partially within said coil, a metallic valve plunger disposed at least partially within said coil and being mounted for reciprocating linear movement relative to said coil and core for controlling the discharge of liquid from said nozzle, said housing being made of a non-metallic, non-magnetic conductive material such that over at least a portion of an elongated length of said coil no metallic flux-directing material is disposed outwardly of the coil, and a metallic flux-directing element adjacent an end of said coil for directing flux in a loop at least partially encompassing said core and plunger in response to energization of said coil for effecting reciprocating linear movement of said plunger.

15. The apparatus of claim 14 in which said flux-deflecting member extends in outward radial relation to said core and plunger.

16. The spray gun of claim 15 in which said metal flux-deflecting member is an annular plate-like member with a central opening.

17. The spray gun of claim 15 in which said flux-deflecting member being disposed in a plane perpendicular to an axis of said coil.

18. The spray gun of claim 17 in which said flux-deflecting member has an outer diameter less than the outer diameter of said coil.

19. The spray gun of claim 17 in which said core has a forwardly extending metal tube within which said plunger is disposed for reciprocating movement, and said flux-deflecting member has a central opening greater than the diameter of said tube and core and extends in outwardly radial direction with respect thereto.

20. The spray gun of claim 15 in which said metal flux-deflecting member is disposed at a downstream end of said coil.

21. The spray gun of claim 15 in which said housing includes a pressurized air inlet for connection to a pressurized air supply source for enabling communication of air through said gun to said nozzle for assisting in atomization and direction of liquid discharging from said nozzle including a plastic body portion within which said liquid and air inlets are formed and a plastic cover mounted in forwardly extending relation to said body which defines a chamber within which said coil is contained.

* * * * *